US009121663B2

(12) United States Patent
Troy et al.

(10) Patent No.: US 9,121,663 B2
(45) Date of Patent: Sep. 1, 2015

(54) STOCK ASSEMBLY AND RECOIL SYSTEM FOR A FIREARM

(71) Applicants: Stephen P. Troy, Lee, MA (US); Thomas Gray, Westfield, MA (US); David A. Hewes, Chesterfield, MA (US)

(72) Inventors: Stephen P. Troy, Lee, MA (US); Thomas Gray, Westfield, MA (US); David A. Hewes, Chesterfield, MA (US)

(73) Assignee: Troy Industries, Inc., West Springfield, MA (US)

( * ) Notice: Subject to any disclaimer, the term of this patent is extended or adjusted under 35 U.S.C. 154(b) by 48 days.

(21) Appl. No.: 14/152,174

(22) Filed: Jan. 10, 2014

(65) Prior Publication Data

US 2014/0190056 A1 Jul. 10, 2014

Related U.S. Application Data

(60) Provisional application No. 61/750,898, filed on Jan. 10, 2013.

(51) Int. Cl.
*F41C 23/14* (2006.01)
*F41C 23/04* (2006.01)
*F41C 23/06* (2006.01)

(52) U.S. Cl.
CPC ..... *F41C 23/14* (2013.01); *F41C 23/04* (2013.01); *F41C 23/06* (2013.01)

(58) Field of Classification Search
CPC ..... F41C 23/00; F41C 23/04; F41C 23/06; F41C 23/12; F41C 23/14; F41A 3/78; F41A 3/80; F41A 3/84
USPC ..... 42/71.01, 72, 73, 75.03
See application file for complete search history.

(56) References Cited

U.S. PATENT DOCUMENTS

| | | | | |
|---|---|---|---|---|
| 5,726,377 | A * | 3/1998 | Harris et al. | 89/191.01 |
| 5,827,992 | A * | 10/1998 | Harris et al. | 89/191.01 |
| 6,829,974 | B1 * | 12/2004 | Gwinn, Jr. | 89/130 |
| 7,162,822 | B1 * | 1/2007 | Heayn et al. | 42/73 |
| 7,213,498 | B1 * | 5/2007 | Davies | 89/198 |
| 7,478,495 | B1 * | 1/2009 | Alzamora et al. | 42/74 |
| 7,793,453 | B1 * | 9/2010 | Sewell et al. | 42/73 |
| 7,827,722 | B1 * | 11/2010 | Davies | 42/75.02 |
| 7,966,761 | B1 * | 6/2011 | Kuczynko et al. | 42/73 |
| 8,037,806 | B2 * | 10/2011 | Davies | 89/198 |
| 8,296,984 | B2 * | 10/2012 | Kincel | 42/1.06 |
| 8,297,175 | B1 * | 10/2012 | Davies | 89/191.01 |
| 8,434,252 | B2 * | 5/2013 | Holmberg | 42/1.06 |
| 8,631,601 | B2 * | 1/2014 | Langevin et al. | 42/73 |
| 8,707,850 | B1 * | 4/2014 | Davies | 89/191.01 |
| 8,943,947 | B2 * | 2/2015 | Gomez | 89/191.01 |

(Continued)

*Primary Examiner* — Benjamin P Lee
(74) *Attorney, Agent, or Firm* — Robert A. Parsons; Michael W. Goltry; Parsons & Goltry

(57) ABSTRACT

A stock and recoil system for a firearm includes a lower receiver, a bolt carrier, and a stock assembly. The bolt carrier is reciprocally movable along an axis within an upper receiver carried by the lower receiver and includes a tubular rearward end defining a cavity with a rearwardly directed opening. The stock assembly is coupled the lower receiver and includes a receiver extension coupled to the lower receiver and aligned on the axis. An action spring is carried within the receiver extension and extends therefrom into the tubular rearward end of the bolt carrier. The action spring is movable between a compressed configuration and an expanded configuration during the firing cycle of the firearm. A butt plate is adjustably coupled to the receiver extension and is movable between an extended position and a collapsed position.

18 Claims, 5 Drawing Sheets

(56) References Cited

U.S. PATENT DOCUMENTS

| | | | | |
|---|---|---|---|---|
| 8,955,422 | B1 * | 2/2015 | Schumacher | 89/198 |
| 8,991,088 | B1 * | 3/2015 | Young | 42/75.03 |
| 2010/0071246 | A1 * | 3/2010 | Vesligai | 42/75.03 |
| 2010/0242333 | A1 * | 9/2010 | Kincel | 42/73 |
| 2010/0251587 | A1 * | 10/2010 | Kincel | 42/1.06 |
| 2011/0209377 | A1 * | 9/2011 | Davies | 42/16 |
| 2012/0023802 | A1 * | 2/2012 | Vesligai | 42/71.01 |
| 2012/0137872 | A1 * | 6/2012 | Crommett | 89/193 |
| 2013/0192114 | A1 * | 8/2013 | Christenson | 42/16 |
| 2014/0041518 | A1 * | 2/2014 | Neitzling | 89/191.01 |

* cited by examiner

STOCK ASSEMBLY AND RECOIL SYSTEM FOR A FIREARM

CROSS-REFERENCE TO RELATED APPLICATION

This application claims the benefit of U.S. Provisional Patent Application No. 61/750,898, filed 10 Jan. 2013.

FIELD OF THE INVENTION

This invention relates to firearms.

More particularly, the present invention relates to stocks for firearms.

BACKGROUND OF THE INVENTION

In the field of firearms, and in particular shoulder fired firearms, it is desirable to have a shortened profile for ease in use and increase portability. It is also desirable that the shortening of the firearm does not adversely impact the performance of the firearm. While firearms are often shortened by reducing barrel length, the length of the barrel has a great impact on the range and accuracy of the firearm. It would therefore be advantageous to reduce the length of the firearm without necessarily reducing the length of the barrel, limiting the reduction of the barrel or reducing the length of the barrel as far as possible and still further reducing the length of the firearm. Reducing the length of the firearm separate from the barrel length requires that reducing the length of the firearm behind the receiver be contemplated. In some types of shoulder fired firearms a stock extends rearwardly from the receiver. To enhance accuracy and usability, as well as being a part of the operating system, these firearms employ a buffering system carried rearward of the receiver and within the stock. However, buffering systems carried rearward of the receivers of the firearm typically result in an inability to shorten that same firearm. Thus, to shorten the firearm, the buffer system must be removed, adversely affecting the operation of the firearm.

It would be highly advantageous, therefore, to remedy the foregoing and other deficiencies inherent in the prior art.

An object of the present invention is to provide a shortened stock assembly and recoil system for a firearm.

SUMMARY OF THE INVENTION

Briefly, to achieve the desired objects and advantages of the instant invention, provided is a stock and recoil system for a firearm including a lower receiver having a forward end and a rearward end, a bolt carrier, and a stock assembly. The bolt carrier is reciprocally movable along an axis within an upper receiver carried by the lower receiver and includes a tubular rearward end defining a cavity with a rearwardly directed opening. The stock assembly is coupled to the rearward end of the lower receiver and includes a receiver extension having a forward end coupled to the rearward end of the lower receiver aligned on the axis and a closed rearward end. An action spring is carried within the receiver extension and extends from the closed rearward end passed the forward end and is received by the tubular rearward end of the bolt carrier. The action spring is movable between a compressed configuration and an expanded configuration. A butt plate is adjustably coupled to the receiver extension and is movable between an extended position and a collapsed position.

Also provided is a bolt carrier which can include an inner carrier weight received within and coupled to the tubular rearward end of the bolt carrier. A kinetic weight is reciprocally movable rearwardly and forwardly on the tubular rearward end of the bolt carrier, and is retained on the bolt carrier by the inner carrier weight.

BRIEF DESCRIPTION OF THE DRAWINGS

Specific objects and advantages of the instant invention will become readily apparent to those skilled in the art from the following detailed description of a preferred embodiment thereof taken in conjunction with the drawings, in which.

DETAILED DESCRIPTION OF THE PREFERRED EMBODIMENT

Figure 1:
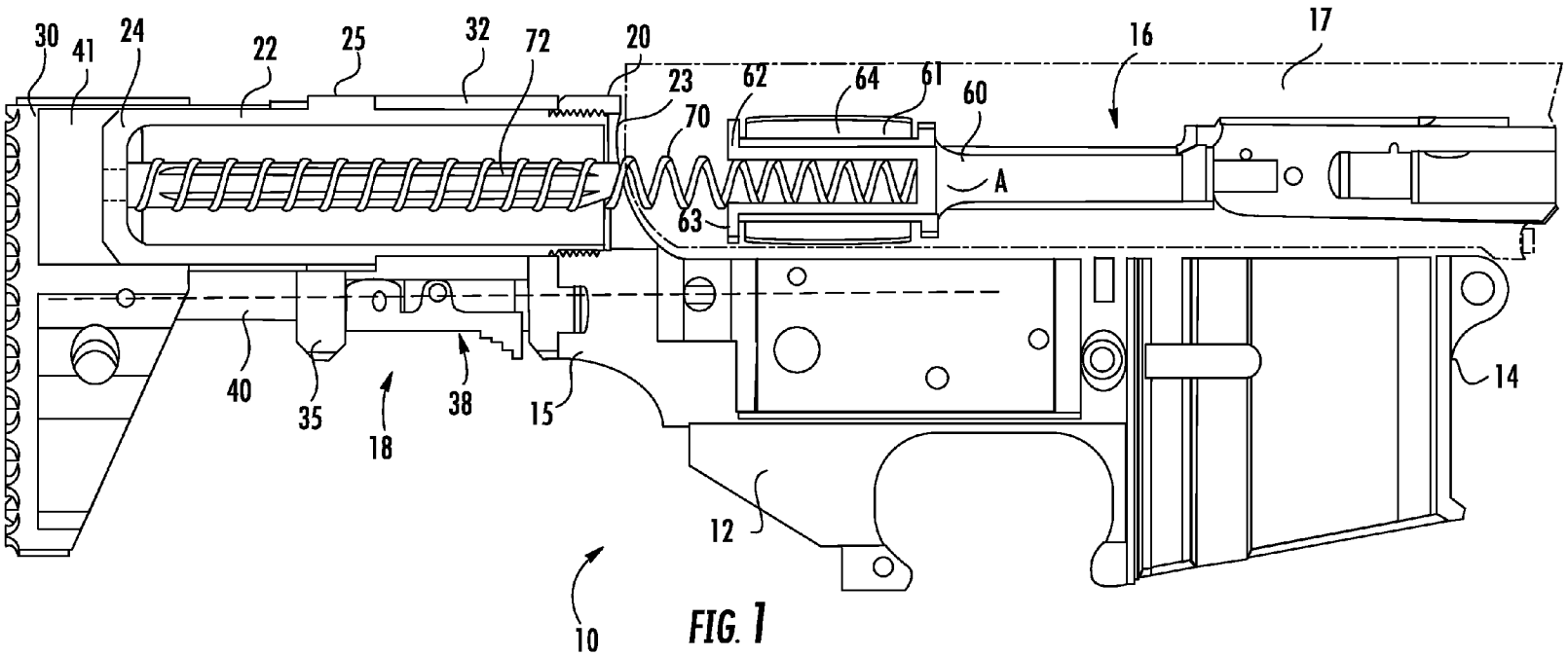
FIG. 1 is a sectional side view of a stock and recoil system according to the present invention.
Figure 2:
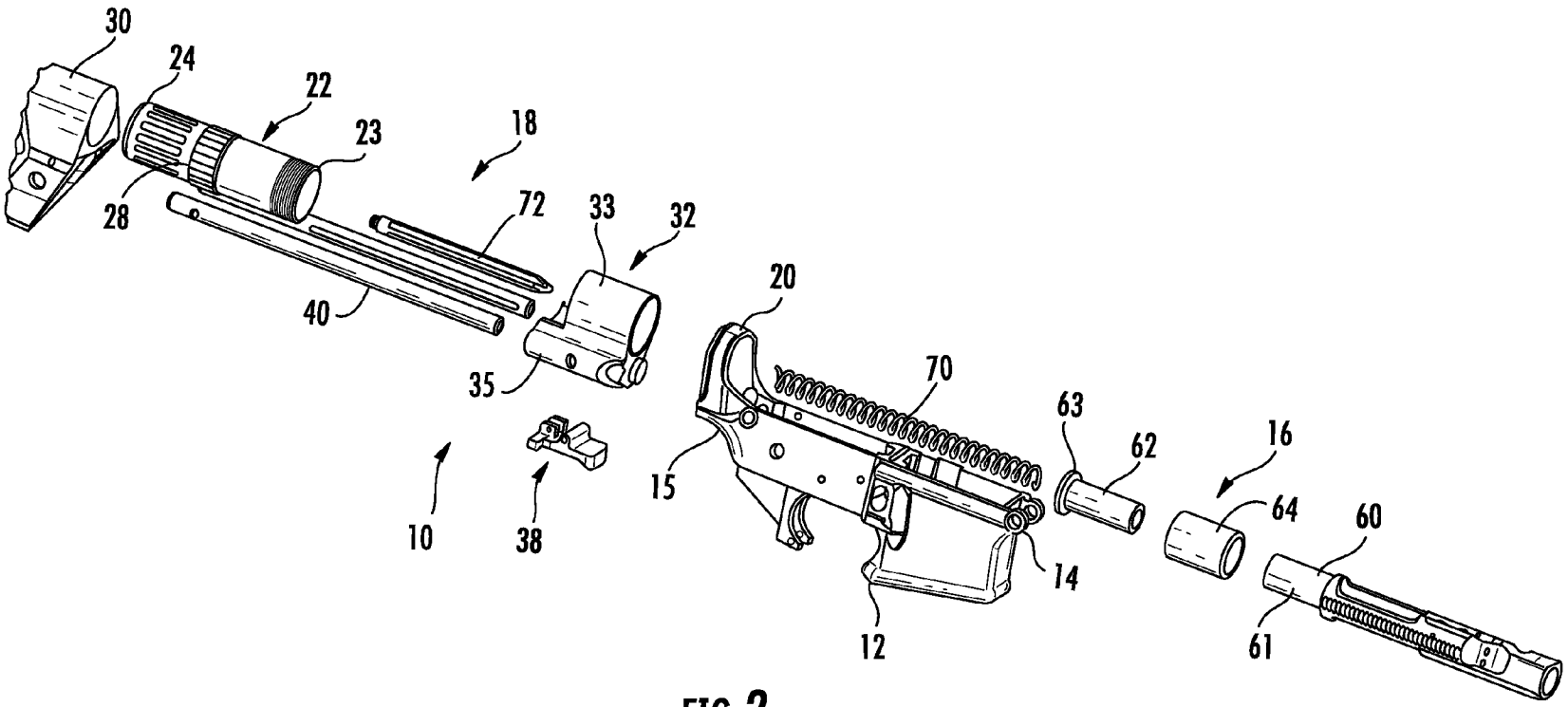
FIG. 2 is an exploded side view in perspective of the stock and recoil system of FIG. 1.

Turning now to the drawings in which like reference characters indicate corresponding elements throughout the several views, attention is first directed to FIGS. 1 and 2 which illustrate a portion of a firearm generally designated 10. Firearm 10 includes a lower receiver 12 having a forward end 14 and a rearward end 15, a bolt carrier system 16 reciprocally movable along an axis designated A within an upper receiver 17 (shown by broken lines) carried by and positioned above lower receiver 12, and a stock assembly 18 coupled to rearward end 15 of lower receiver 12. In the present invention, the preferred firearm used in conjunction with the stock and the recoil system is an AR15/M16 type firearm, although it will be understood that similar systems can be employed. The stock and recoil system of the present invention shortens the conventional carbine AR15 recoil system to allow a more compact firearm. Lower receiver 12 will not be described in detail, as it is well known to those of ordinary skill in the art, other than to detail a threaded receptacle 20 which normally receives a buffer tube used in conventional firearms of this type. In conventional firearms of this type, the length of the firearm can be reduced only to certain limits, such as the length of the buffer tube. In the present invention, the buffer tube is removed, and replaced with a receiver extension 22. The receiver extension is preferably substantially shorter than the buffer tube, such as 4 or more inches shorter. This allows the firearm to be that much shorter, as will be described presently.

Stock assembly 18 includes receiver extension 22 which is a generally tubular member having a threaded forward end 23 threadably received by threaded receptacle 20, a closed rearward end 24 and an encircling raised collar 25 extending radially outwardly from an outer surface thereof intermediate forward end 23 and rearward end 24. Raised collar 25 includes a plurality of detent grooves 28 extending longitudinally therealong and formed around a circumference thereof. Stock assembly 18 further includes a butt plate 30 coupled to receiver extension 22 by a stock knuckle 32. Stock knuckle 32 has a tubular portion 33 and a guide portion 35 extending from a lower surface thereof. Tubular portion 33 of stock knuckle 32 is received over forward end 23 of receiver extension 22 and captured between raised collar 25 and threaded receptacle 20. An adjustment mechanism 38 is carried by guide portion 35.

Butt plate 30 is adjustably coupled to guide portion 35 of stock knuckle 32 by a pair of stock rods 40 extending from butt plate 30 and slidably received by guide portion 35 on opposing sides of stock knuckle 32. With additional reference to FIGS. 3, 4 and 5, in the fully collapsed position, butt plate 30 slides over rearward end 24 of receiver extension 22, the rearward end of the receiver extension being received in a cavity 41 defined in butt plate 30, reducing overall length. In the fully collapsed position, stock rods 40 are positioned to either side of lower receiver 12. The firearm is fully functional in this configuration with stock rods 40 not affecting the firing of the firearm. Stock rods 40 each include predetermined stock length adjustment locking notches 42 to allow adjustment of the stock between a fully collapsed position and a fully extended position. Stock rods 40 each further include a groove 44 on an inwardly directed surface thereof, extending from proximate a forward end to a position spaced from a rearward end thereof. Grooves 44 receive a spring loaded detent inside guide portion 35 above adjustment mechanism 38 that limits the range of movement of stock rods 40 through knuckle 32 so that butt plate 30 will not be able to be completely removed without releasing the detents. Preferably, the stock rod detents and spring are held in place independently of adjustment mechanism 38.

Figure 3:
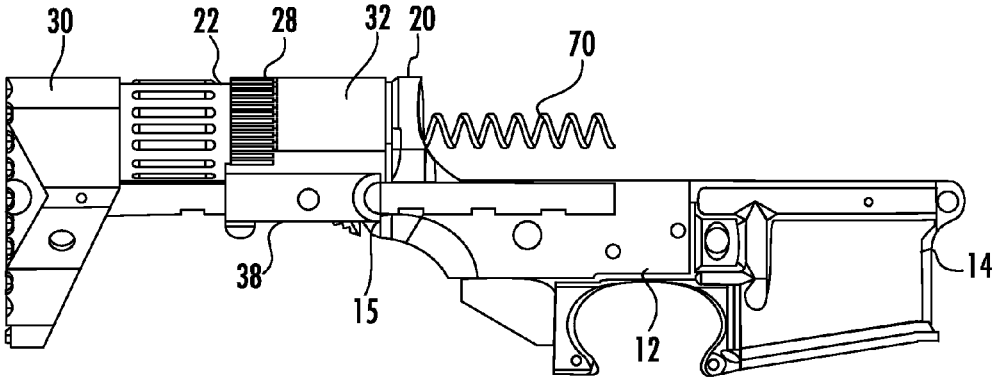
FIG. 3 is a side view of the butt stock with a receiver extension.
Figure 4:
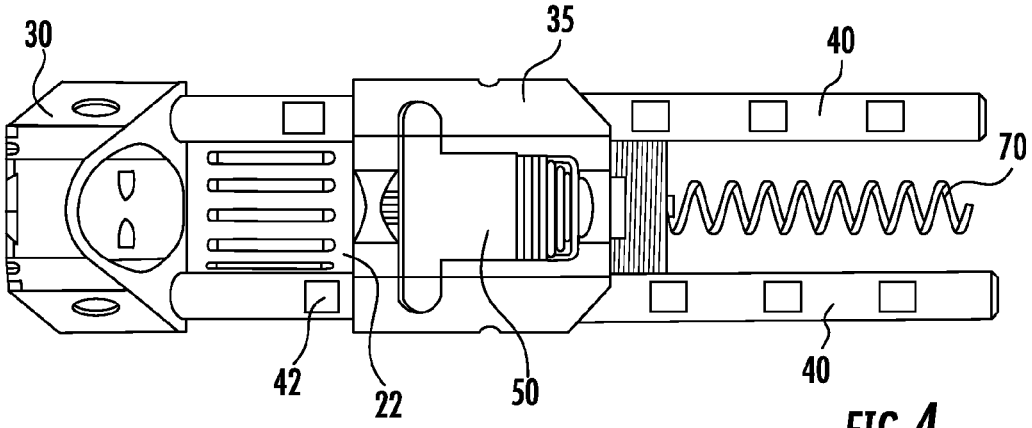
FIG. 4 is a bottom view of the stock with the receiver extension.
Figure 5:
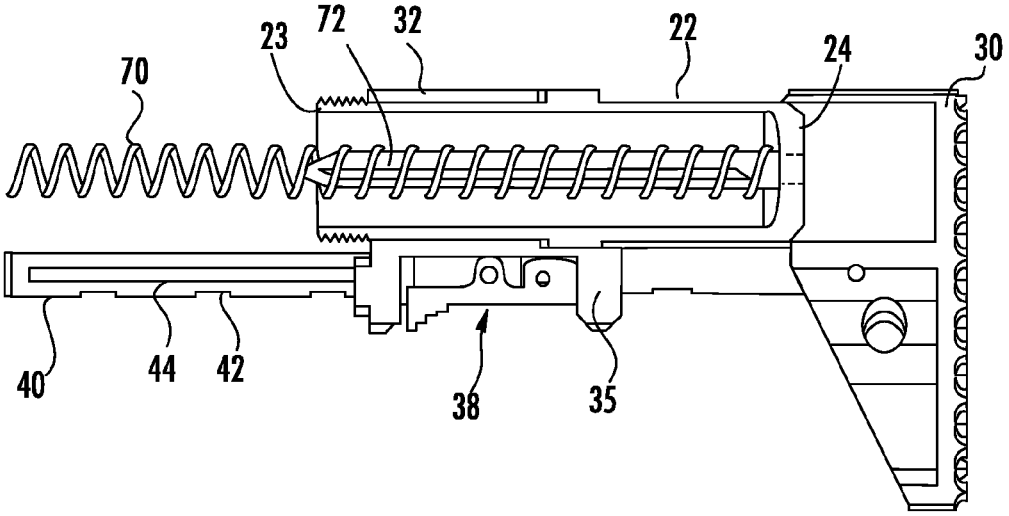
FIG. 5 is a sectional side view of the stock with the receiver extension.
Figure 6:
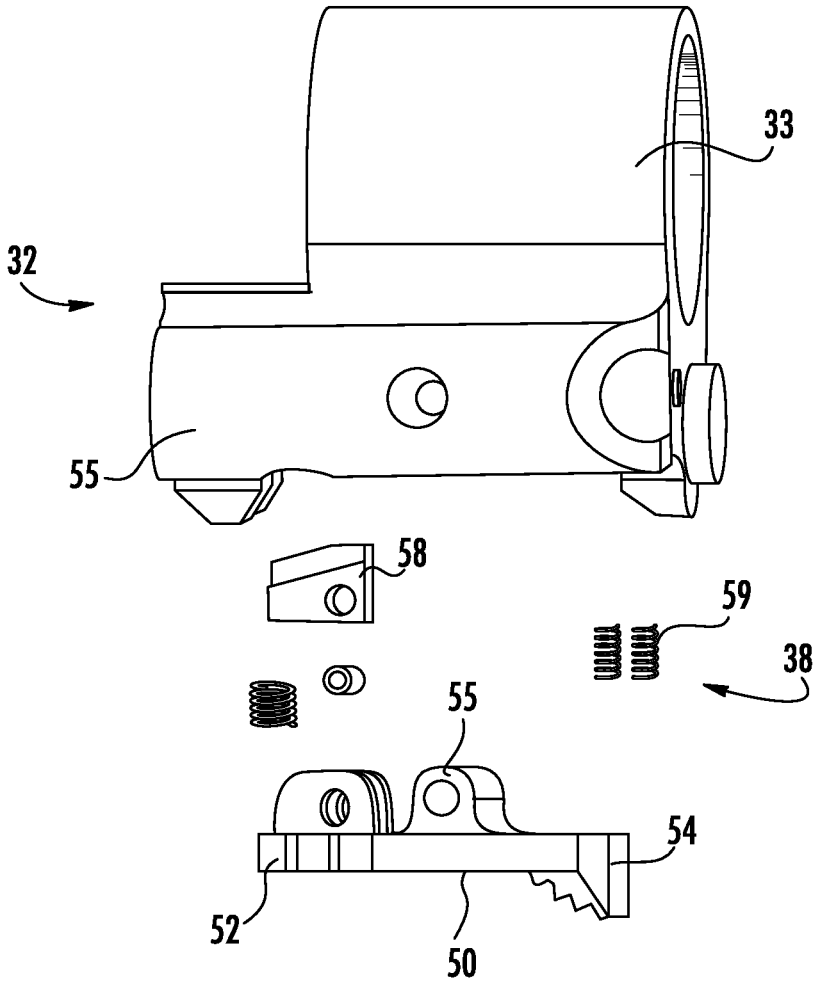
FIG. 6 is an enlarged exploded view of the stock knuckle and adjustment latch.

Still referring to FIGS. 1-3, with additional reference to FIGS. 4 and 6, adjustment mechanism 38 includes a pivoting latch 50 having a detent end 52 and a biased end 54. Latch 50 pivots about a central pivot point 55 between a locked and an unlocked position. In the locked position, detent end 52 forces a detent member 58 upwardly to engage receiver extension 22. Biased end 54 is biased to retain latch 50 in the locked position by springs 59. Receiver extension 22 is self-locking by the insertion of detent member 58 into one of detent grooves 28. When latch 50 is moved to the unlocked position, receiver extension 22 can be threaded or unthreaded from threaded receptacle 20. When latch 50 is in the locked position, detent member 58 prevents rotation of receiver extension 22, locking it in place. In this manner, receiver extension 22 is securely coupled to receiver 12, but can be removed and installed easily by hand. It should be noted that latch 50 is in line with locking notches 42 on rods 40 so that the direction of the force will not allow the stock to adjust from impact.

Figure 7:
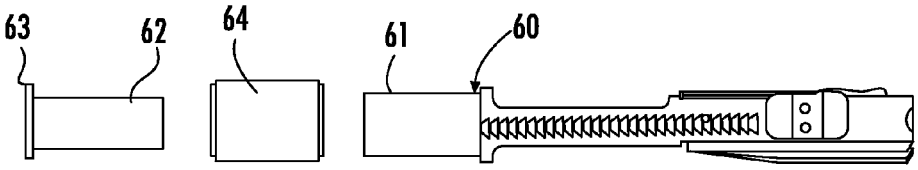
FIG. 7 is a side view of the bolt carrier system.

Still referring to FIGS. 1 and 2, with additional reference to FIG. 7, bolt carrier system 16 includes a bolt carrier 60 having a tubular rearward end 61 defining a cavity with a rearwardly directed opening, an inner carrier weight 62 received within and coupled to tubular rearward end of bolt carrier 60, and a kinetic weight 64. Kinetic weight 64 moves reciprocally rearwardly and forwardly on tubular rearward end 61 of bolt carrier 60 to prevent bolt bounce. Inner carrier weight 62 includes a flange 63 which keeps kinetic weight 64 from coming off bolt carrier 60 when the firearm cycles. An action spring 70 is carried within receiver extension 22 and extends from rearward end 24 passed forward end 23 and is received through inner carrier weight 62 and into tubular rearward end 61 within bolt carrier system 16. Action spring 70 fits into inner carrier weight 62 and allows bolt carrier 60 to cycle, giving the spring the area needed to reach its solid compressed state without over stressing the spring. Action spring 70 is received over a spring guide 72 extending longitudinally through receiver extension from rearward end 24, for proper spring compression and alignment.

Various changes and modifications to the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A stock and recoil system for a firearm comprising:
- a lower receiver having a forward end and a rearward end;
- a bolt carrier reciprocally movable along an axis within an upper receiver carried by the lower receiver, the bolt carrier having a tubular rearward end defining a cavity with a rearwardly directed opening;
- a stock assembly coupled to the rearward end of the lower receiver, the stock assembly comprising:
  - a receiver extension having a forward end coupled to the rearward end of the lower receiver aligned on the axis and a closed rearward end;
  - an action spring carried within the receiver extension and extending from the closed rearward end passed the forward end and received by the cavity in the tubular rearward end of the bolt carrier, the action spring movable between a compressed configuration and an expanded configuration; and
  - a butt plate adjustably coupled to the receiver extension and movable between an extended position and a collapsed position.

2. A stock and recoil system for a firearm as claimed in claim 1 wherein the bolt carrier further comprises:
- an inner carrier weight received within and coupled to the tubular rearward end of the bolt carrier; and
- a kinetic weight reciprocally movable rearwardly and forwardly on the tubular rearward end of the bolt carrier, and retained on the bolt carrier by the inner carrier weight.

3. A stock and recoil system for a firearm as claimed in claim 1 wherein the receiver extension further includes a spring guide extending longitudinally through receiver extension from the rearward end, the action spring received over the spring guide for proper spring compression and alignment.

4. A stock and recoil system for a firearm as claimed in claim 1 wherein the receiver extension further includes an encircling raised collar extending radially outwardly from an outer surface thereof intermediate the forward end and the rearward end.

5. A stock and recoil system for a firearm as claimed in claim 4 wherein the stock assembly further includes the butt plate coupled to the receiver extension by a stock knuckle, the stock knuckle comprising:
- a tubular portion received over the forward end of the receiver extension and captured between the raised collar and the rearward end of the lower receiver; and
- a guide portion extending from a lower surface of the tubular portion.

6. A stock and recoil system for a firearm as claimed in claim 5 wherein the butt plate is adjustably coupled to the guide portion of the stock knuckle and movable between the extended position and the collapsed position by a pair of stock rods extending from the butt plate and slidably received by the guide portion on opposing sides of the stock knuckle.

7. A stock and recoil system for a firearm as claimed in claim 6 wherein, in the collapsed position, the butt plate slides over the rearward end of the receiver extension, the rearward end of the receiver extension being received in a cavity defined in the butt plate.

8. A stock and recoil system for a firearm as claimed in claim 6 wherein each of the stock rods include predetermined stock length adjustment locking notches to allow adjustment of the stock between the fully collapsed position and the fully extended position.

9. A stock and recoil system for a firearm as claimed in claim 8 wherein, the stock rods each further include a groove on an inwardly directed surface thereof, extending from proximate a forward end to a position spaced from a rearward end thereof, the grooves receive a spring loaded detent carried inside the guide portion that limits the range of movement of the stock rods through the knuckle.

10. A stock and recoil system for a firearm as claimed in claim 6 wherein the stock knuckle further includes an adjustment mechanism comprises:

a pivoting latch having a detent end and a biased end, the pivoting latch pivotally attached to the guide portion and pivotal about a central pivot point between a locked and an unlocked position; and a detent member carried by the guide member and forced upwardly to engage the receiver extension by the detent end in the locked position, and disengaged from the receiver extension in the unlocked position, the biased end being biased to retain the pivoting latch in the locked position.

11. A stock and recoil system for a firearm comprising:

a lower receiver having a forward end and a rearward end;

a bolt carrier reciprocally movable along an axis within an upper receiver carried by the lower receiver, the bolt carrier having a tubular rearward end defining a cavity with a rearwardly directed opening;

an inner carrier weight received within and coupled to the tubular rearward end of the bolt carrier;

a kinetic weight reciprocally movable rearwardly and forwardly on the tubular rearward end of the bolt carrier, the kinetic weight retained on the bolt carrier by the inner carrier weight;

a stock assembly coupled to the rearward end of the lower receiver, the stock assembly comprising:

a receiver extension having a forward end coupled to the rearward end of the lower receiver aligned on the axis and a closed rearward end;

an action spring carried within the receiver extension and extending from the closed rearward end passed the forward end and received by the cavity in the tubular rearward end of the bolt carrier, the action spring movable between a compressed configuration and an expanded configuration; and a butt plate adjustably coupled to the receiver extension and movable between an extended position and a collapsed position.

12. A stock and recoil system for a firearm as claimed in claim 11 wherein the receiver extension further includes a spring guide extending longitudinally through receiver extension from the rearward end, the action spring received over the spring guide for proper spring compression and alignment.

13. A stock and recoil system for a firearm as claimed in claim 11 wherein the stock assembly further includes the butt plate coupled to the receiver extension by a stock knuckle, the stock knuckle comprising:

a tubular portion received over the forward end of the receiver extension and captured between a raised collar extending radially outwardly from an outer surface of the receiver extension intermediate the forward end and the rearward end and the rearward end of the lower receiver; and a guide portion extending from a lower surface of the tubular portion.

14. A stock and recoil system for a firearm as claimed in claim 13 wherein the butt plate is adjustably coupled to the guide portion of the stock knuckle and movable between the extended position and the collapsed position by a pair of stock rods extending from the butt plate and slidably received by the guide portion on opposing sides of the stock knuckle.

15. A stock and recoil system for a firearm as claimed in claim 14 wherein, in the collapsed position, the butt plate slides over the rearward end of the receiver extension, the rearward end of the receiver extension being received in a cavity defined in the butt plate.

16. A stock and recoil system for a firearm as claimed in claim 15 wherein each of the stock rods include predetermined stock length adjustment locking notches to allow adjustment of the stock between the fully collapsed position and the fully extended position.

17. A stock and recoil system for a firearm as claimed in claim 16 wherein, the stock rods each further include a groove on an inwardly directed surface thereof, extending from proximate a forward end to a position spaced from a rearward end thereof, the grooves receive a spring loaded detent carried inside the guide portion that limits the range of movement of the stock rods through the knuckle.

18. A stock and recoil system for a firearm as claimed in claim 15 wherein the stock knuckle further includes an adjustment mechanism comprises:

a pivoting latch having a detent end and a biased end, the pivoting latch pivotally attached to the guide portion and pivotal about a central pivot point between a locked and an unlocked position; and a detent member carried by the guide member and forced upwardly to engage the receiver extension by the detent end in the locked position, and disengaged from the receiver extension in the unlocked position, the biased end being biased to retain the pivoting latch in the locked position.

* * * * *